US006102390A

United States Patent [19]

DeFigueiredo et al.

[11] Patent Number: 6,102,390

[45] Date of Patent: Aug. 15, 2000

[54] SEPARATOR STONE ADJUSTMENT ASSEMBLY

[75] Inventors: Carlos L DeFigueiredo, Sandy Hook; William J Wright, Killingworth, both of Conn.

[73] Assignee: Pitney Bowes Inc., Stamford, Conn.

[21] Appl. No.: 09/316,009

[22] Filed: May 21, 1999

Related U.S. Application Data

[63] Continuation of application No. 08/925,267, Sep. 9, 1997, Pat. No. 5,975,519.

[51] Int. Cl.[7] ..... B65H 3/54

[52] U.S. Cl. ..... 271/124; 271/117; 271/273

[58] Field of Search ..... 271/121, 122, 271/124, 125, 10.11, 273, 274, 117

[56] References Cited

U.S. PATENT DOCUMENTS

| | | | |
|---|---|---|---|
| 3,908,983 | 9/1975 | Long | 271/125 X |
| 4,324,396 | 4/1982 | Albright et al. | 271/274 X |
| 4,501,417 | 2/1985 | Foster et al. | 271/124 |
| 4,728,095 | 3/1988 | Irvine et al. | 271/124 |
| 4,775,140 | 10/1988 | Foster | 271/121 |
| 5,120,043 | 6/1992 | Marzullo | 271/124 |
| 5,152,519 | 10/1992 | Ifkovits, Jr. | 271/121 X |

*Primary Examiner*—Christopher P. Ellis
*Assistant Examiner*—Patrick Macky
*Attorney, Agent, or Firm*—Christopher J. Capelli; Michael E. Melton

[57] ABSTRACT

A separator assembly operative to separate and feed individual documents from a storage tray of an inset feeder apparatus. The separator assembly including an adjustment assembly configured to adjustably position the separator roller relative to the separator stone. The separator assembly further includes a leverage assembly configured to raise the separator roller from an adjusted position to a height suitable for clearing a paper jam and to return the separator roller to the adjusted position relative to the separator stone. The leverage assembly and adjustment assembly both having respective operator actuated mechanisms positioned atop one of the first and second side portions of the feeder apparatus.

6 Claims, 5 Drawing Sheets

SEPARATOR STONE ADJUSTMENT ASSEMBLY

This application is a continuation of application Ser. No. 08/925,267 filed Sep. 9, 1997, now U.S. Pat. No. 5,975,519.

FIELD OF THE INVENTION

The present invention relates generally to multi-station document inserting systems, which assemble batches of documents for insertion into envelopes. More particularly, the present invention is directed toward a separator stone adjustment assembly for insert feeder assemblies in multi-station document inserting systems.

BACKGROUND OF THE INVENTION

Multi-station document inserting systems generally include a plurality of various stations that are configured for specific applications. Typically, such inserting systems, also known as console inserting machines, are manufactured to perform operations customized for a particular customer. Such machines are known in the art and are generally used by organizations, which produce a large volume of mailings where the content of each mail piece may vary.

For instance, inserter systems are used by organizations such as banks, insurance companies and utility companies for producing a large volume of specific mailings where the contents of each mail item are directed to a particular addressee. Additionally, other organizations, such as direct mailers, use inserts for producing a large volume of generic mailings where the contents of each mail item are substantially identical for each addressee. Examples of such inserter systems are the 8 series and 9 series inserter systems available from Pitney Bowes, Inc., Stamford, Conn.

In many respects the typical inserter system resembles a manufacturing assembly line. Sheets and other raw materials (other sheets, enclosures, and envelopes) enter the inserter system as inputs. Then, a plurality of different modules or workstations in the inserter system work cooperatively to process the sheets until a finished mailpiece is produced. The exact configuration of each inserter system depends upon the needs of each particular customer or installation. For example, a typical inserter system includes a plurality of serially arranged stations including an envelope feeder, a plurality of insert feeder stations and a burster-folder station. There is a computer generated form or web feeder that feeds continuous form control documents having control coded marks printed thereon to the burster-folder station for separating and folding. A control scanner located in the burster-folder station senses the control marks on the control documents. Thereafter, the serially arranged insert feeder stations sequentially feed the necessary documents onto a transport deck at each station as the control document arrives at the respective station to form a precisely collated stack of documents. The collated stack is then transported to the envelope feeder-insert station where the stack is inserted into the envelope. The transport deck preferably includes a ramp feed so that the control documents always remain on top of the stack of advancing documents. A typical modern inserter system also includes a control system to synchronize the operation of the overall inserter system to ensure that the collations are properly assembled.

Specifically regarding insert feeder stations, it is known in the art to use a separator wheel assembly for separating and feeding individual sheets from a stack of sheets. One type of separator, known as an interference type separator includes a separator wheel which operates in cooperation with a separator stone extending through the feed deck for performing the separating task. Generally, in an interference type separator, the separator wheel includes a plurality of angular grooves into which a plurality of inclined raised members, commonly referred to as fingers, of the separator stone protrude. The documents are fed through the bite between the separator wheel and the separator stone with the grooves in the feed roller. An example of such an interference type separator is shown in commonly assigned U.S. Pat. Nos. 4,501,417 and 5,120,043, both hereby incorporated by reference.

The nature of separator assemblies, and in the particular with the interference type separator, is that an adjustment must be made to the spaced relationship or "bite" between the separator wheel and the separator stone whenever there is a change in documents to be fed. Typically, the bite between the separator wheel and the separator stone is adjustable for the purpose of feeding documents of various thicknesses. The adjustment once made is locked into place until documents of other thicknesses are to be fed.

Generally, when a paper jam occurs at the separator assembly, the jam cannot be cleared without some damage to the jammed sheet. The most reliable way for clearing jams at the separator assembly is through the feed path downstream from the separator assembly. However, in many instances this may require the removal of a machine cover over the downstream feed path, and may require reaching into the rollers and belts in the feed path to retrieve the jammed sheet. Even in this instance, the sheet may be damaged because of the interference relationship of the stone fingers and the separator wheel.

Another problem encountered with such insert feeders is that the adjustment mechanism for setting the bite between the separator roller and separator stone is typically atop the insert feeder which location is directly above the main deck of the inserter system. This location is disadvantageous in that each time an operator desires to change the bite between the separator roller and separator stone, the operator is required to at least partially lean over the main deck which is both awkward and potentially dangerous in view of the various moving assemblies on the main deck of the inserter system.

Therefore, it is an object of the present invention to overcome the difficulties associated with feeder assemblies for conveying an insert from a storage tray onto a high speed paper deck of a document inserting system.

SUMMARY OF THE INVENTION

The present invention provides an apparatus for conveying an insert from a storage tray of an insert feeder onto a main deck of a paper inserting system. More particularly, the present invention provides a separator assembly located at a side portion of the main deck having mechanisms for adjusting the bite between the separator roller and the separator stone roller and providing jam access in the separator assembly.

In accordance with the present invention, the separator assembly is provided on a feeder apparatus having a frame with parallel spaced apart first and second side portions and a feed deck coupled to the frame. The separator assembly is mounted on the feeder apparatus and is operative to separate and feed individual documents from a storage tray. More particularly, the separator assembly includes a separator stone having at least a portion extending above the feed deck and a separator roller positioned above and in adjustable spaced relationship to the separator stone. The separator assembly further includes an adjustment assembly configured to adjustably position the separator roller relative to the separator stone. The adjustment assembly provides a first operator actuated mechanism positioned atop one of the first and second side portions of the feeder apparatus.

The separator assembly further includes a leverage assembly configured to raise the separator roller from an adjusted position to a height suitable for clearing a paper jam and to return the separator roller to the adjusted position relative to the separator stone. The leverage assembly has a second operator actuated mechanism positioned atop one of the first and second side portions of the feeder apparatus in close proximity to the first operator actuated mechanism.

BRIEF DESCRIPTION OF THE DRAWINGS

The above and other objects and advantages of the present invention will become more readily apparent upon consideration of the following detailed description, taken in conjunction with accompanying drawings, in which like reference characters refer to like parts throughout the drawings and in which.

DETAILED DESCRIPTION OF THE PREFERRED EMBODIMENT

Figure 1:
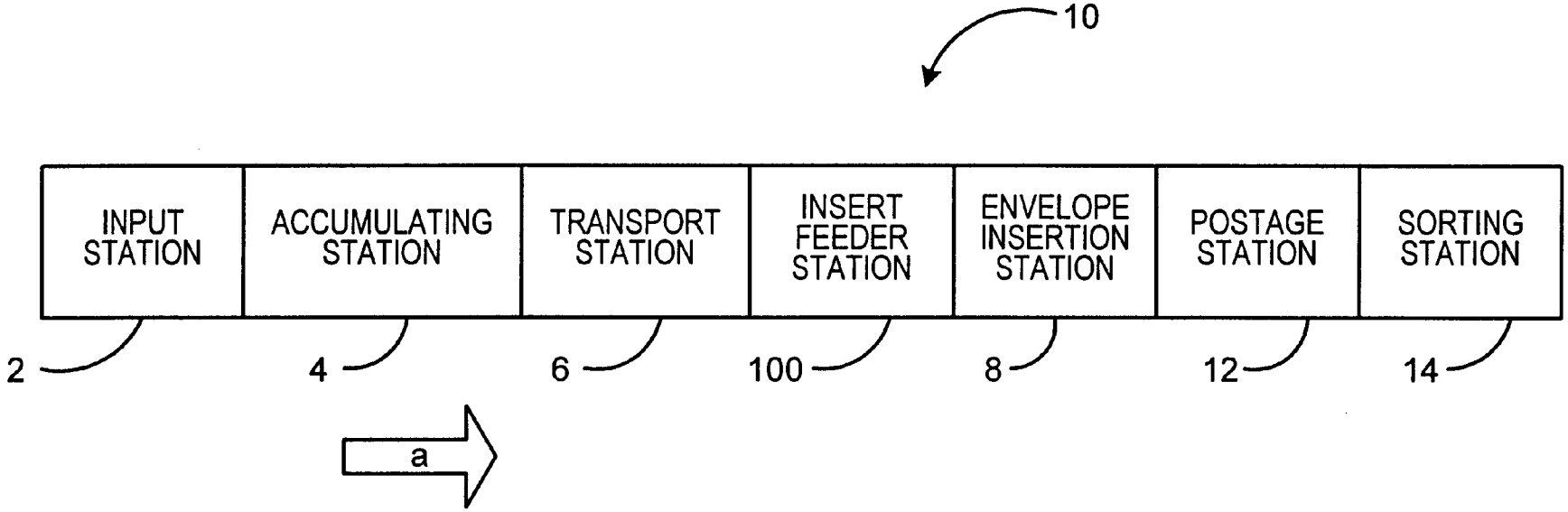
FIG. 1 is a schematic of a document inserting system in which the present invention is incorporated.

In describing the preferred embodiment of the present invention, reference is made to the drawings, wherein there is seen in FIG. 1 a schematic of a typical document inserting system, generally designated 10, which implements the present invention insert feeder assembly 100. In the following description, numerous paper handling stations implemented in inserter system 10 are set forth to provide a thorough understanding of the operating environment of the present invention. However it will become apparent to one skilled in the art that the present invention may be practiced without the specific details in regards to each of these paper-handling stations.

Figure 2:
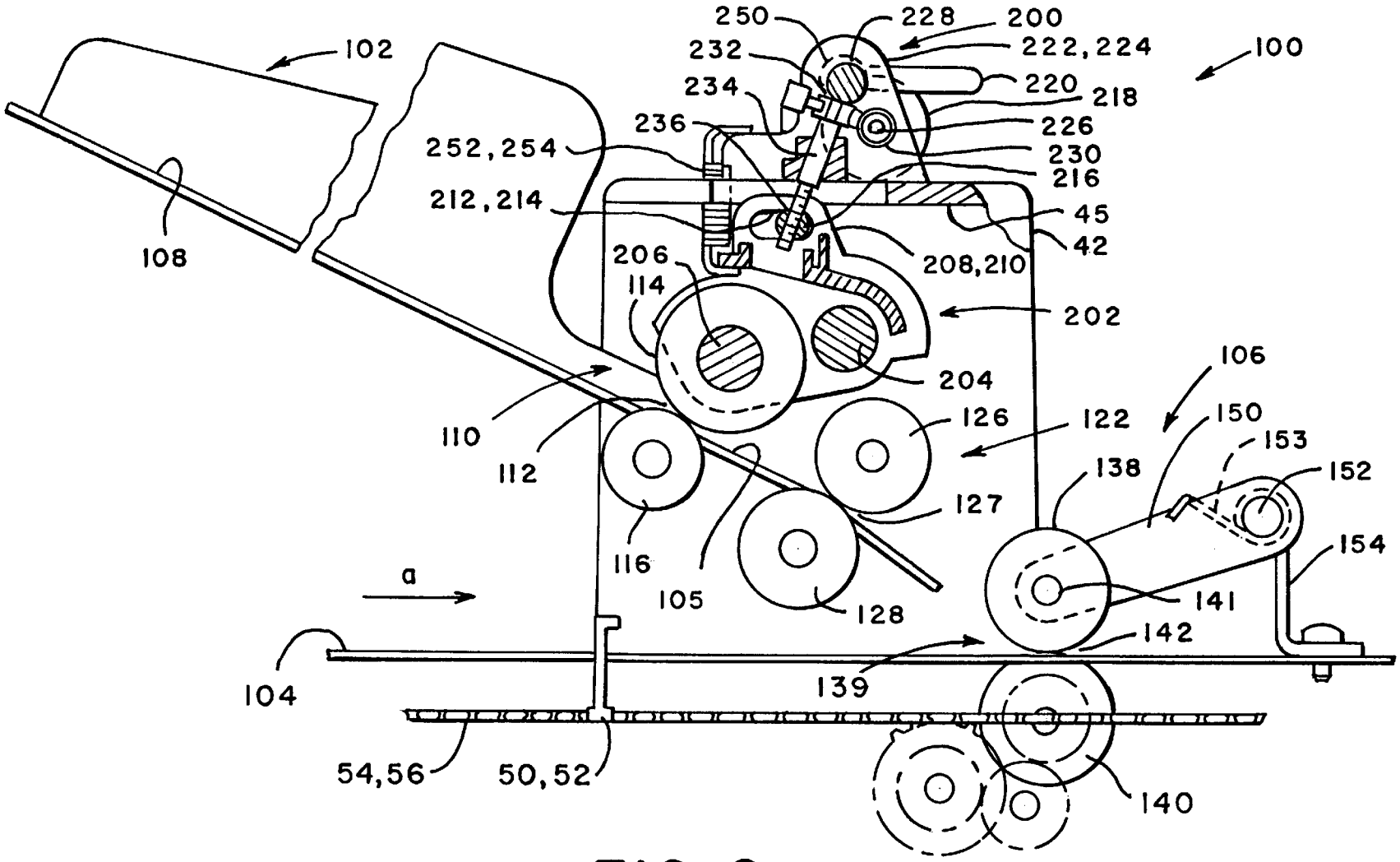
FIG. 2 is a partial cross-sectional view of an embodiment of the present invention feeder assembly implemented in the document inserting system shown in FIG. 1.
Figure 3:
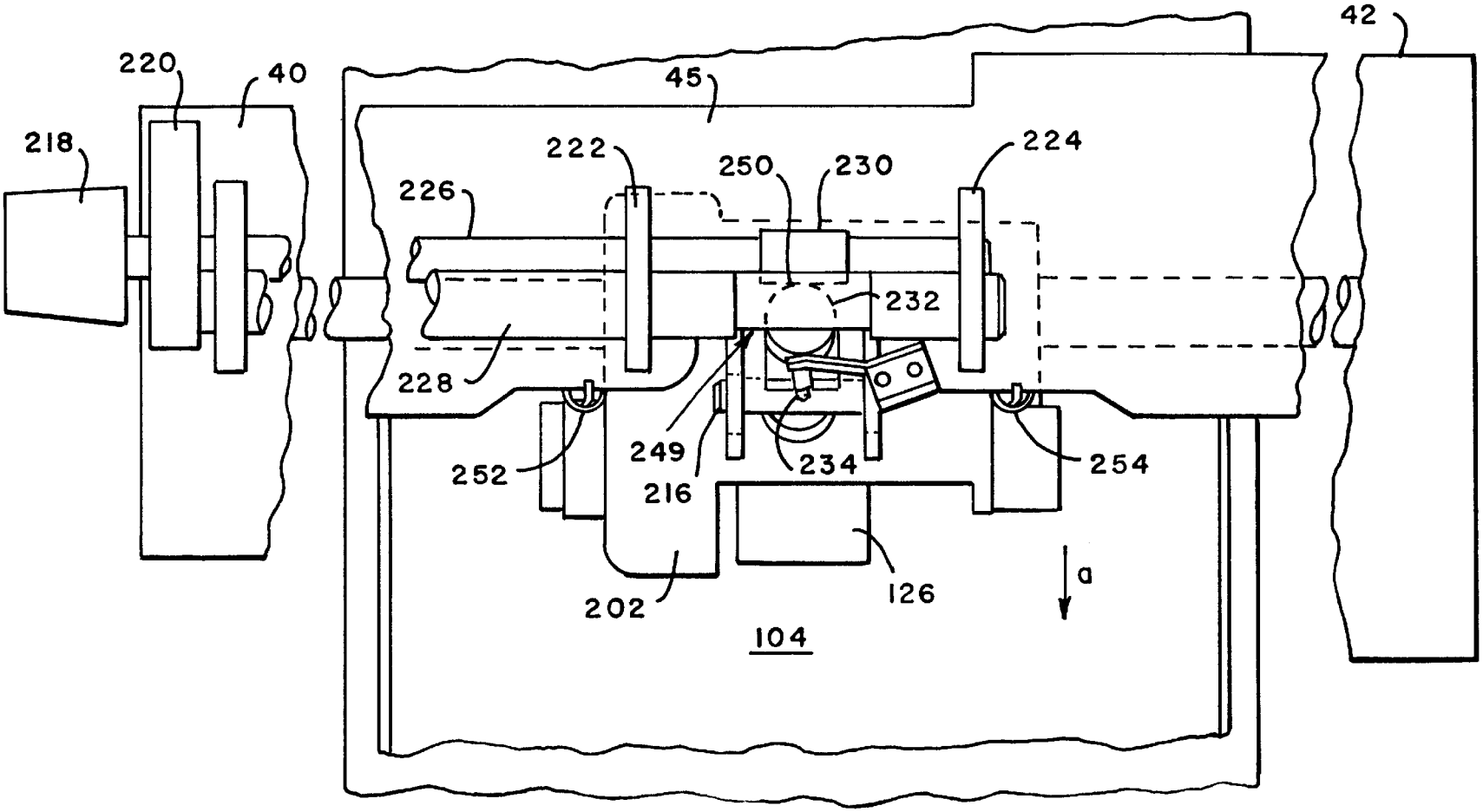
FIG. 3 is a top planar view of the feeder assembly shown in FIG. 2.

System 10 preferably includes an input station 2 that feeds paper sheets (preferably from a paper web) to an accumulating station 4 that accumulates the sheets of paper. Essentially, input station 2 feeds sheets in a paper path, as indicated by arrow "a," along what is termed the "main deck" of inserter system 10. It is to be appreciated that such an input station consist of well known devices such as, but not limited to, a sheet burster, a cut sheet feeder, a sheet transporter, etc. Further, such an accumulating station is well known, an example of which is described in commonly assigned U.S. Pat. No. 5,083,769, hereby incorporated by reference. The accumulated sheets are then conveyed to a transport station 6 (also well known in the art), preferably operative to perform buffering operations for maintaining a proper timing scheme for processing documents in inserting system 10. It is pointed out, and as is well known, that the accumulation of sheets are conveyed along the main deck of inserter system 10 through the action of a pair of advancing pusher fingers 54 and 56 (FIGS. 2 and 3). Essentially, the pusher fingers 50 and 52 maintain the integrity of the sheet accumulation as well as provide the force necessary to convey the accumulation of sheets through inserter system 10.

The accumulation of sheets is feed from transport station 6 to the present invention insert feeder station 100. It is to be appreciated that a typical inserter system 10 includes a plurality of feeder stations, but for clarity of illustration only a single insert feeder 100 is shown in the drawings depicting the inserter system 10 implementing the present invention. As will be discussed in more detail below, insert feeder 100 is operational to convey an insert (e.g., an advertisement) into the aforesaid accumulation of sheets being conveyed along the main deck of inserter 10.

The accumulation of sheets (containing the insert) are then conveyed into an envelope insertion station 8 that is operative to insert the accumulation into an envelope, which envelope is preferably thereafter sealed and addressed. The envelope is then conveyed to postage station 12 that applies appropriate postage thereto. Finally, the envelope is preferably conveyed to a sorting station 14 that sorts the envelopes in accordance with postal discount requirements.

As is conventional, inserter system 10 includes a control system (not shown) that controls and harmonizes operation of the various stations implemented in inserter system 10. Such a control system is well known in the art and since it forms no part of the present invention, it is not described in detail in order not to obscure the present invention. Similarly, since none of the other above-mentioned stations (namely: input station 2, accumulating station 4, transport station 6, envelope insertion station 8, postage station 12 and sorting station 14) form no part of the present invention insert feeder station 100, further discussion of each of these stations is also not described in detail in order not to obscure the present invention. Further, it is to be appreciated that the embodiment of inserter system 10 implementing the present invention insert feeder station 100 is only to be understood as an example configuration of such an inserter system 10. It is of course to be understood that such an inserter system may have many other configurations in accordance with a specific user's needs.

Referring now to FIGS. 2 and 3, the present invention insert feeder 100 is shown. Insert feeder 100 is provided with a separator adjustment assembly 200 enabling adjustment of the separator gap nip 112 and providing jam clearance access to the separator gap nip 112, both of which is described in more detail below.

Insert feeder 100 consists of a storage tray assembly 102 supported above the main deck 104 of inserter system 10. Insert feeder 100 further consists of a main deck insert drive assembly 106 having components aligned in the paper path (as indicated by arrow "a") on the main deck 104 of inserter system 10. Storage tray assembly 102 is mounted between a pair of side plates 40 and 42, each upstanding from the sides of the main deck 104 of the inserter system 10. As will be discussed in more detail below, storage tray assembly 102 is operational to convey an insert from the feed deck 105 of a storage tray assembly 102 onto the main deck 104 of inserter system 10, which conveyance occurs from a location above the main deck 104. Insert drive assembly 106 then provides positive drive to the insert being conveyed from the feed deck 105 of storage tray assembly 102 when the leading edge of the conveying insert comes into proximity of the main deck 104.

As previously mentioned, a pair of pusher fingers 50 and 52 are provided in inserter system 10 to convey an accumulation of sheets along the main deck 104 for processing in the various stations of inserter system 10. As is conventional, pusher fingers 50 and 52 are substantially parallel to one another and are orthogonal relative to the longitudinal axis defined by the paper path on the main deck 104 (as represented by arrow "a" in FIG. 3). Each pusher finger 50 and 52 is coupled to a common driving assembly 54 (e.g., a drive chain) for providing drive to each pusher finger 50 and 52.

In regards to storage assembly 102 of feeder assembly 100, it includes a storage tray 108 for storing a stack of inserts. A separator roller assembly 110 is provided for individually feeding an insert from the stack of inserts disposed in storage tray 108 and includes a driven separator drive roller 114 and fixed separator stone roller 116 partially extending through an opening formed in feed deck 105. As is conventional, the spaced relationship of the nip 112 formed by separator drive roller 114 and fixed separator stone roller 116 is functional to ensure that only a single (not more than one) insert is fed to the feed roller assembly 122 provided at the exit area of insert storage assembly 102. Counterclockwise drive is provided to separator drive roller 114 through conventional drive means (e.g., operatively associated belts, gears, motors, clutches, etc.) (not shown).

Figure 2A:
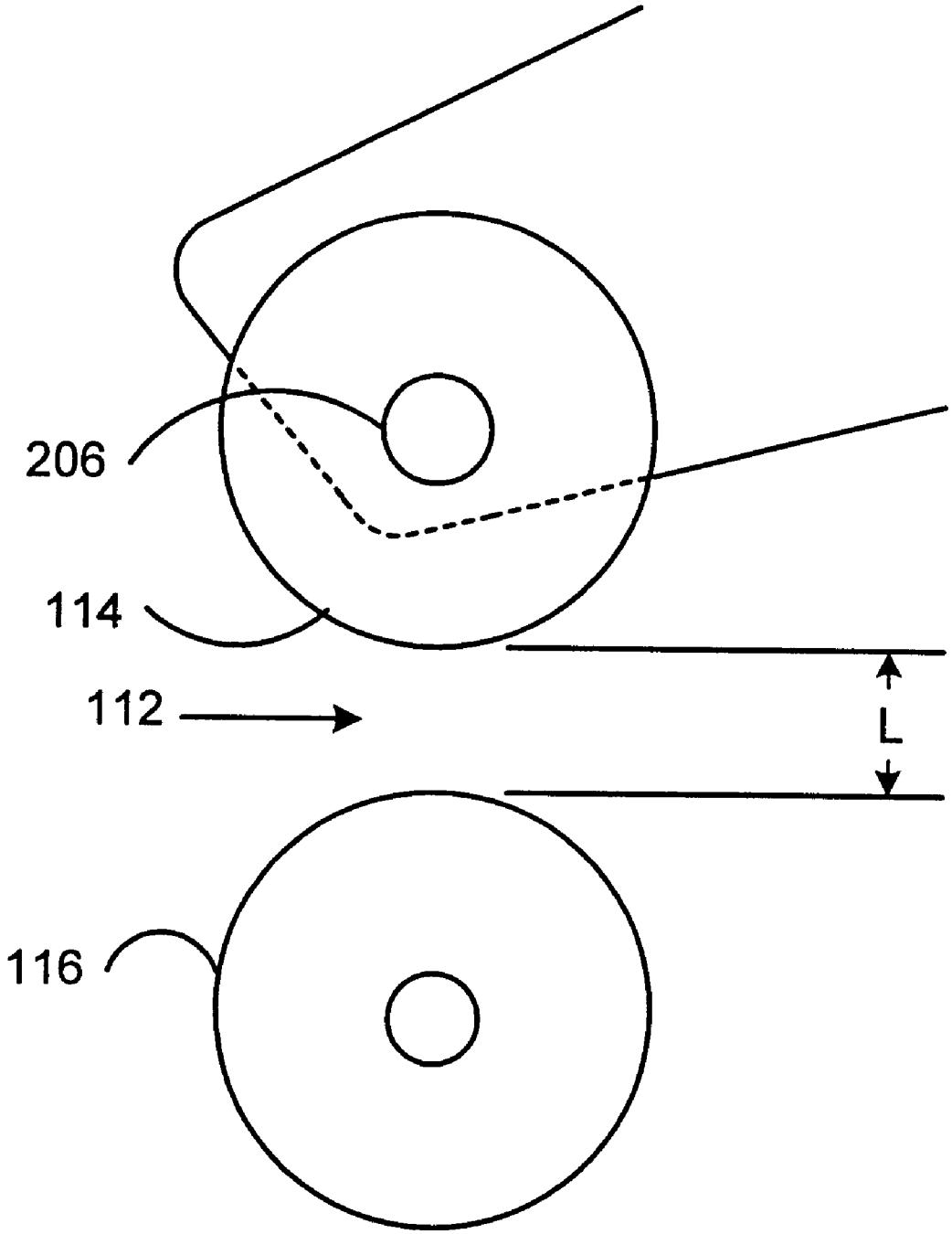
FIG. 2*a* is a partial cross-sectional view depicting the spatial relationship of the separator roller with the fixed separator stone in the feeder assembly shown in FIG. 2.

As is well known, and referring to FIG. 2*a*, a gapped distance "L" is provided between drive roller 114 and separator stone 116, which distance is commonly referred to as the bite between the separator stone 116 and the separator roller 114. Thus, if the thickness of the bite is substantially the thickness of a single insert, only a single insert will be delivered from the bottom of the insert stack disposed in tray 108. The single insert delivery is generally the desired result. If the bite between the separator roller 114 and separator stone 116 is equal to the thickness between several insert pieces, then a stream of inserts will be concurrently delivered from the stack of inserts disposed in tray 108. Thus, each time there is a change in the inserts (e.g., of a different thickness) to be conveyed from storage tray 108, the bite between the separator roller 114 and separator stone 116 must be adjusted accordingly to ensure that only a single insert will be conveyed from storage tray 108.

Accordingly, the separator adjustment assembly 200 is provided on feeder assembly 100 to adjust the spaced relationship or "bite" between the separator roller 114 and the separator stone 116. Separator adjustment assembly 200 includes a housing 202 pivotably mounted about a fixed shaft 204 supported between frame members 40 and 42. Separator roller 114 is concentrically mounted about a shaft 206 rotatably supported in housing 202. The upper portion of housing 202 is formed with spaced apart support members 208 and 210, each defining an elongated opening 212 and 214. A sliding shaft 216 extends between support members 208 and 210 wherein the respective ends of shaft 216 are slidably mounted within each respective elongate opening 212 and 214. With continuing reference to FIGS. 2 and 3, separator adjustment assembly 200 further includes an adjustment knob 218 and jam clearance lever 220 both being situated atop a side plate 40 upstanding from the side of the main deck 104. As will be discussed further below, adjustment knob 218 is operative to adjust the bite 112, between the separator roller 114 and separator stone 116. And jam clearance lever 220 is operative to pivot housing 202 upwards relative to separator stone 116 so as to provide jam clearance access between separator stone 116 and separator roller 114.

A bridge member 45 extends between side plates 40 and 42 and above the main deck 104 of inserter system 10 and housing 202. Mounted atop bridge member 45 is a pair of parallel spaced upstanding support members 222 and 224. An elongate adjustment shaft 226 extends from knob 218 through openings formed in support members 222 and 224 wherein an end of shaft 226 is rotatably mounted in an opening formed in support member 224. Similarly, an elongate leverage shaft 228 extends from lever 220 through openings formed in support members 222 and 224, wherein an end of shaft 228 is rotatably mounted in an opening formed in support member 224.

Regarding adjustment shaft 226, a portion of this shaft intermediate support members 222 and 224 is provided with a worm gear 230 in operative digitation with a cooperating worm gear 232 provided on the upper end of a separator shaft 234. Separator shaft 234 has a lower threaded end 236 in threaded engagement with a threaded opening formed in sliding shaft 216 intermediate support members 208 and 210. Preferably, counter-clockwise rotation of separator shaft 234 causes sliding shaft 216 to move downward along the lower threaded end 236 of separator shaft 234 subsequently causing housing 202, and in turn separator roller 114 to pivot downward about shaft 204 and towards separator stone 116. Conversely, clockwise rotation of separator shaft 234 causes sliding shaft 216 to move upward along the lower threaded end 236 of separator shaft 234 subsequently causing housing 202, and in turn separator roller 114 to pivot upward about shaft 204 and away from separator stone 116.

Therefore, separator shaft 234 is caused to rotate by rotation of adjustment shaft 226, via the aforesaid arrangement of worm gears 230 and 232. For example, worm gears 230 and 232 may be configured such that clockwise rotation of adjustment shaft 226 causes corresponding clockwise rotation of separator shaft 234 and counter-clockwise rotation of adjustment shaft 226 causes corresponding counter-clockwise rotation of separator shaft 234.

Thus, in operation, when an operator desires to decrease the distance (bite) between the separator roller 114 and separator stone 116, the operator simply counter-clockwise rotates the adjustment knob 218 positioned above the side of the main deck 104 causing corresponding counter-clockwise rotation of adjustment shaft 226, which in turn causes corresponding counter-clockwise rotation of separator shaft 234, via worm gears 230 and 232. As previously mentioned, counter-clockwise rotation of separator shaft 234 causes sliding shaft 216 to move downward along the lower threaded end 236 of separator shaft 234 subsequently causing housing 202, and in turn separator roller 114 to pivot downward about shaft 204 and towards separator stone 116, thereby decreasing the distance (bite) between separator stone 116 and separator roller 114.

Similarly, when an operator desires to increase the distance (bite) between the separator roller 114 and separator stone 116, the operator simply clockwise rotates the adjustment knob 218 causing corresponding clockwise rotation of separator shaft 234, via adjustment shaft 226 worm gears 230 and 232. As previously mentioned, clockwise rotation of separator shaft 234 causes sliding shaft 216 to move upward along the lower threaded end 236 of separator shaft 234 consequently causing housing 202, and in turn separator roller 114 to pivot upward about shaft 204 and away from separator stone 116, thereby increasing the distance (bite) between separator stone 116 and separator roller 114.

As previously mentioned, jam clearance lever 220 is operative to pivot housing 202 upwards relative to separator stone 116 so as to provide jam clearance access between separator stone 116 and separator roller 114 while maintaining the bite setting (i.e., the distance) between separator roller 114 and separator stone 116. Leverage shaft 228 is provided with a cam shaft 249 defining a cam portion 250 intermediate support members 222 and 224, which cam portion 250 is biased against the head portion of separator shaft 234, as best illustrated in FIG. 2. Preferably, a pair of spring members 252 and 254 upwardly bias housing 202 causing the head portion of separator shaft 234 to bias towards the cam portion 250 of leverage shaft 228.

Figure 4:
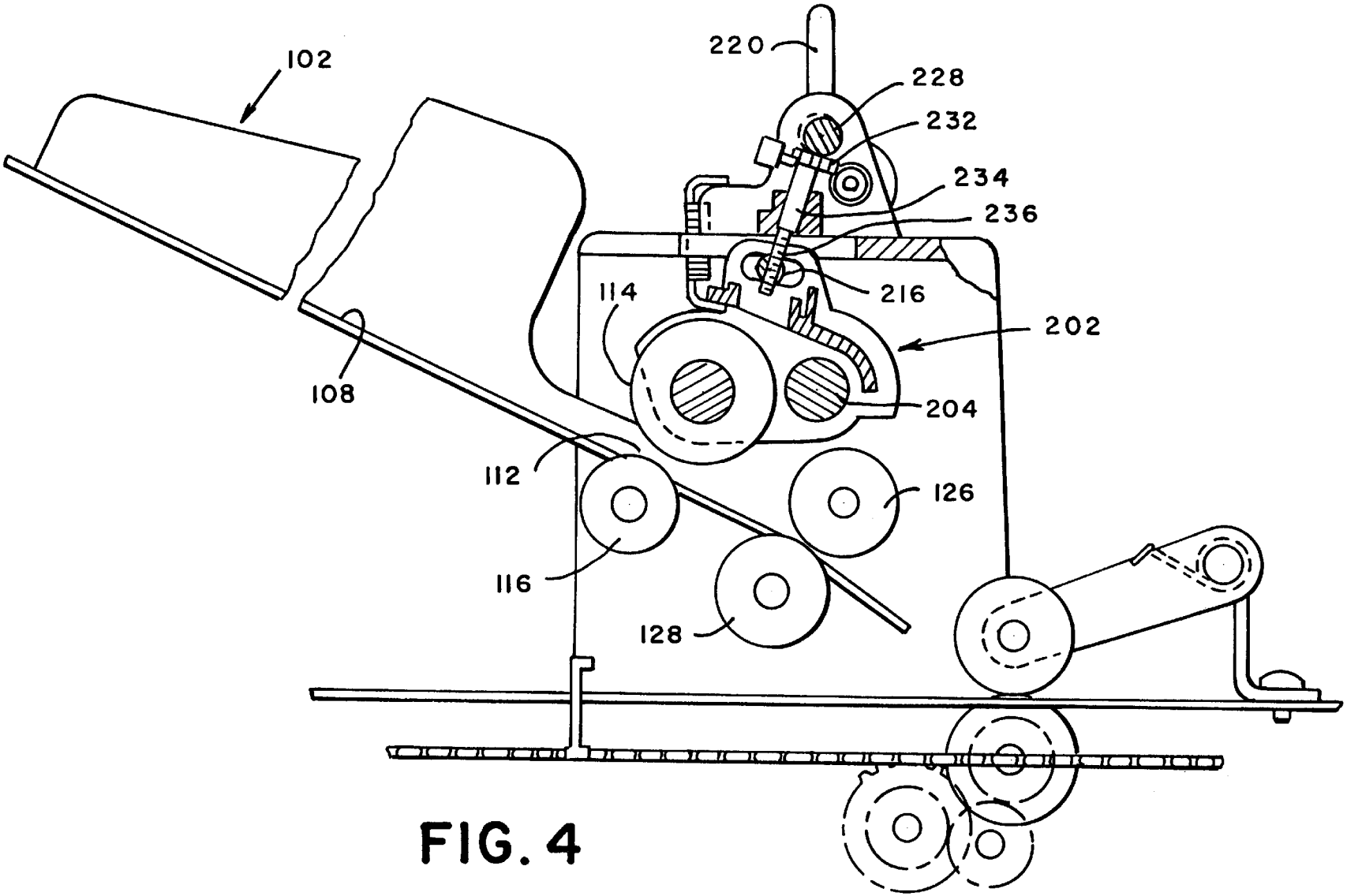
FIG. 4 is a partial cross-sectional view of the feeder assembly of FIG. 2 depicting the separator assembly in a jam clearance position.

When lever 220 is in its home position as depicted in FIG. 2, cam portion 250 of leverage shaft 228 is in a high eccentric position and biases separator shaft 234 downward causing separator roller 114 to be in close proximity with separator stone 116 whereby rotation of adjustment knob 218 prescribes the distance (bite) between the two, as described above. When an operator needs jam clearance access to the nip 112 of separator roller 114 and separator stone 116, the operator rotates lever 220 to its jam clearance access position as depicted in FIG. 4 so as to rotate cam portion 250 to a low eccentric position. Corresponding rotation of the cam portion 250 of leverage shaft 228 into its low eccentric position causes the head of separator shaft 234 to bias upwards against the ellipsoid path of cam portion 250 causing housing 202 to bias upwards about shaft 204. As previously mentioned, upward motion of housing 202 causes separator roller 114 to move away from separator stone 116. It is to be appreciated that when lever 220 is rotated to its jam clearance position (FIG. 4) the spaced distance between separator roller 114 and separator roller 116 is sufficient to enable jam clearance access for an operator.

Rotation of lever 220 back to its home position (FIG. 2) returns separator roller 114 to its previously prescribed distance (bite) relative to separator stone 116. This is because when separator shaft 234 is caused to move upward or downward through the action of lever 220, separator shaft 234 does not rotate (as it is when rotated by worm gears 230 and 232 through rotation of adjustment knob 218), thus its position relative to sliding shaft 216 remains unchanged. Therefore, when lever 220 is caused to return to its home position (FIG. 2), separator shaft 234 subsequently advances downward to its home position wherein the threaded relationship between separator shaft 234 and sliding shaft 216 remains unchanged thus maintaining the distance (bite) between separator roller 114 and separator stone 116 as set prior to the movement of lever 220 from its home position for enabling the aforesaid jam clearance access.

A noted advantage of the above-described adjustment assembly 200 is that it 1) provides for adjustment of the distance (bite) between separator roller 114 and separator stone roller 116 and 2) provides for jam access for the nip 112 formed by separator roller 114 and separator roller 116 while maintaining the prescribed distance (bite) between the later rollers 114 and 116 when returned from the jam access position. Another noted advantage is that both aforesaid adjustment and jam access for adjustment assembly 200 is achieved by an operator from mechanisms (namely, adjustment knob 218 and lever 220) located at the side portion of the main deck 104 of inserter 10, as opposed to above the main deck 104.

Insert feeder 100 further includes a feed roller assembly 122 including an idler roller 126 forming a nip 127 with drive roller 128. A conventional drive system (not shown) provides drive to drive roller 128. Feed roller assembly 122 is functional to convey an insert from storage assembly 102 onto the main deck 104 of inserter system 10, whereby the leading edge of the insert is directed towards the aforesaid insert drive assembly 106 provided on the main deck 104. In other words, the storage assembly 102 expels a single insert onto the main deck 104 of the inserter system 10.

As best shown in FIG. 2, the main deck drive assembly 106 includes an idler roller 138 forming a nip 139 with a drive roller 140. It is pointed out that the distance between the nip 139 of the main deck drive assembly 106 and the nip 127 of the feed roller assembly 122 is preferably less than the lengthwise distance of an insert being conveyed from storage assembly 102, the significance of which will become apparent below. An outer circumference portion of drive roller 140 extends through a cutout 142 formed in the main deck 104. Continuos clockwise drive is provided to drive roller 140 preferably by a motor drive assembly (not shown).

Forming the nip 139 with drive roller 140 is idler roller 138, which is spring biased toward drive roller 140. As best shown in FIG. 2, idler roller 138 has a shaft 141 rotatably mounted to an end of arm member 150, which arm member 150 has its other end pivotably mounted to an end region of shaft 152. A torsion spring 153 is provided on the end region of shaft 152 and is functional to bias arm member 150 and attached idler roller 138 toward drive roller 140. Shaft 152 extends across the main deck 104 and has it opposing end mounted to an upstanding post 154 extending from a position at the side portion of the main deck 104, which position is not in obstruction of the paper path (as indicated by arrow "A") prescribed on the main deck 104 (FIG. 3).

Therefore, the main deck drive assembly 106 is operational to provide a driving force on the main deck 104 to an insert being conveyed from the storage assembly 102 lying above the main deck 104. Thus, even after the tail edge portion of an insert has left the drive nip 127 of feed roller assembly 122 provided on the storage assembly 102, a driving force is still being effected upon the conveying insert, via the drive nip 139 of the main deck drive assembly 106. It is noted that the drive nip 139 of the main deck drive assembly 106 causes an insert to be conveyed into the paper path on the main deck 104 at a speed in correspondence to the main deck paper path speed since the rotational speed of drive roller 140 depends from the speed of chains 54 and 56 (which advance pusher fingers 50 and 52).

Therefore, another advantage of the present invention feeder assembly 100 is that it provides a continuos driving force upon an insert from the time it is conveyed through, and expelled from, a storage tray assembly until the time the insert is nested with an accumulation of sheets on the main deck of an inserter system. This is particularly advantageous in high speed inserter systems where the lag time of when an insert is expelled from a storage tray (in which no driving force is effected upon the insert) until it is nested with the accumulation of sheets on the main deck can cause improper placement of the insert relative to the accumulation of sheets it is intended to be nested with, causing a paper jam in the inserter system.

In summary, a feeder assembly for providing continues drive to a conveying insert has been described. Although the present invention has been described with emphasis on a particular embodiment, it should be understood that the figures are for illustration of the exemplary embodiment of the invention and should not be taken as limitations or thought to be the only means of carrying out the invention. Further, it is contemplated that many changes and modifications may be made to the invention without departing from the scope and spirit of the invention as disclosed.

What is claimed is:

1. A separator assembly for separating and feeding individual documents in a feeder apparatus that conveys the individual documents into a paper path, the feeder apparatus having a frame with parallel spaced apart first and second side portions and a feed deck coupled to the frame, the separator assembly comprising:

a separator stone having at least a portion extending above the feed deck;

a separator roller positioned above and in adjustable spaced relationship to the separator stone;

an adjustment assembly configured to adjustably position the separator roller relative to the separator stone, the adjustment assembly having a first operator actuated mechanism positioned atop one of the first and second side portions of the feeder apparatus; and a leverage assembly configured to raise the separator roller from an adjusted position to a height suitable for clearing a paper jam and to return the separator roller to the adjusted position relative to the separator stone, the leverage assembly having a second operator actuated mechanism positioned atop one of the first and second side portions of the feeder apparatus in close proximity to the first operator actuated mechanism.

2. A separator assembly as recited in claim 1 wherein the adjustment assembly includes a separator shaft having a first end operatively connected to the separator roller and a second end operatively connected to a second end of an elongate adjustment shaft, the elongate adjustment shaft having a first end connected to the first operator actuated mechanism whereby rotation of the elongate adjustment shaft causes corresponding rotation of the separator shaft causing the separator roller to move relative to the separator stone.

3. A separator assembly as recited in claim 2 further including a worm gear arrangement operatively connecting the adjustment shaft to the separator shaft, the worm gear arrangement including a first gear member provided on the second end of the adjustment shaft and a second cooperating gear member provided on the second end of the separator shaft.

4. A separator assembly as recited in claim 2, wherein the leverage assembly includes an elongate leverage shaft in parallel spaced relationship to the adjustment shaft, a first end of the leverage shaft is connected to the second operator actuated mechanism and a second end portion is provided with a cam located above the separator shaft whereby the separator shaft is biased against the cam.

5. A separator assembly as recited in claim 4, wherein the cam is in a high eccentric position when the separator roller is in the adjusted position, the cam being rotated to a low eccentric position when the separator roller is in a raised position.

6. A separator assembly as recited in claim 5, wherein the cam is part of a rotatable cam shaft provided on the second end of the leverage shaft, the cam moving between the high eccentric position and the low eccentric position as the cam shaft is rotated.

* * * * *